US008800180B2

(12) United States Patent
Ong et al.

(10) Patent No.: US 8,800,180 B2
(45) Date of Patent: Aug. 12, 2014

(54) STEAM IRONING DEVICE

(75) Inventors: Chee Keong Ong, Singapore (SG); Mohankumar Valiyambath Krishnan, Singapore (SG); Boon Khian Ching, Singapore (SG); Gary Chi Yang Lim, Singapore (SG); Wai Hong Fong, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/993,544

(22) PCT Filed: Dec. 12, 2011

(86) PCT No.: PCT/IB2011/055597

§ 371 (c)(1), (2), (4) Date: Jun. 12, 2013

(87) PCT Pub. No.: WO2012/085746

PCT Pub. Date: Jun. 28, 2012

(65) Prior Publication Data

US 2013/0255114 A1 Oct. 3, 2013

(30) Foreign Application Priority Data

Dec. 23, 2010 (EP) ..... 10196803

(51) Int. Cl.

*D06F 75/26* (2006.01)
*D06F 75/24* (2006.01)
*D06F 75/12* (2006.01)

(52) U.S. Cl.

USPC ..... 38/77.6; 219/250; 392/394

(58) Field of Classification Search

USPC ..... 38/74–77.9, 82–85, 93; 219/245, 250, 219/254–257; 392/399, 394, 449

See application file for complete search history.

(56) References Cited

U.S. PATENT DOCUMENTS

| | | | | |
|---|---|---|---|---|
| 7,721,474 | B2 * | 5/2010 | Jiang et al. | 38/77.7 |
| 2003/0206730 | A1 * | 11/2003 | Golan | 392/399 |
| 2005/0005480 | A1 * | 1/2005 | Asvadi et al. | 38/77.7 |
| 2010/0166396 | A1 * | 7/2010 | Xu et al. | 392/394 |
| 2011/0146115 | A1 * | 6/2011 | Ong | 38/77.8 |
| 2012/0039586 | A1 * | 2/2012 | Collinson et al. | 392/400 |

FOREIGN PATENT DOCUMENTS

| | | | |
|---|---|---|---|
| DE | 102009055163 | A1 | 6/2011 |
| WO | 9623099 | A1 | 8/1996 |
| WO | 0155496 | A1 | 8/2001 |
| WO | 2006000958 | A1 | 1/2006 |
| WO | 2008034693 | A1 | 3/2008 |
| WO | 2011080026 | A2 | 7/2011 |

* cited by examiner

*Primary Examiner* — Ismael Izaguirre

(57) ABSTRACT

A steam ironing device (1), comprising: an iron, including a soleplate (18) provided with at least one steam outlet opening (20); soleplate heating means (22) configured to heat the soleplate (18); a steam generator (50) including a heatable steam generation chamber (51) that is fluidly connectable to the at least one steam outlet opening (20) in the soleplate; and control means (24, 56), operably connected to the soleplate heating means (22) and the steam generator (50), and configured to control a soleplate temperature and a steam rate of the steam ironing device, wherein the control means (24, 56) are configured to heat the soleplate to a non user-adjustable temperature in the range of 105-145° C., and to provide for a time-averaged steam rate of at least 50 grams/minute.

9 Claims, 3 Drawing Sheets

STEAM IRONING DEVICE

FIELD OF THE INVENTION

The present invention relates to a steam ironing device suitable for steam ironing different types of fabric.

BACKGROUND

It is a well known fact that an ironing temperature, i.e. the temperature to which an item that is being ironed is heated during the ironing process, is to be chosen in dependence of the type of fabric of the item in order to obtain optimal ironing results. For example, in case the item is made of cotton, the ironing temperature may be relatively high, e.g. around 175° C., whereas when the item to be ironed is made of polyamide or elastane, the ironing temperature should be much lower, e.g. about 95° C., so as to avoid scorching of the item.

Which approximate ironing temperature is to be used for ironing a certain fabric type to obtain optimal ironing results can be found in a variety of publications including encyclopedic and/or instructional internet websites, ironing device user manuals with recommendations from the manufacturers, and patent publications. A further authorative category of publications concerns international standardization norms, including for example ISO 3758 (Textiles—Care labelling code using symbols') from the International Organization for Standardization, and European Standard EN 60311 ('Electric irons for household or similar use—methods for measuring performance') originating from the European Committee for Standardization and approved by the European Committee for Electrotechnical Standardization. The ISO standard has introduced textile care markings for maximum ironing temperatures. The textile care labelling of the ISO standard is indicated by one, two and three dots placed within an ironing symbol. The European Standard takes account of the recommendations of the ISO standard, but to obtain improved ironing results the temperatures have been adjusted as shown in the following table:

TABLE 1

| Marking | Soleplate temperature (° C.) | Material, for example |
|---|---|---|
| • (1 dot) | 95 ± 25 | acetate, elastane, polyamide, polypropylene |
| •• (2 dots) | 130 ± 30 | cupro, polyester, silk, triacetate, viscose, wool |
| ••• (3 dots) | 175 ± 35 | cotton, linen |

Hence, although the precise temperatures may differ, it is generally acknowledged that an item is best ironed at a temperature that corresponds to the nature of the fabric it is made of.

In agreement with this insight, virtually all contemporary domestic (steam) irons come equipped with a heatable soleplate whose temperature is manually adjustable within a range of about 70-210° C. To properly iron a certain fabric with such an iron, the user is expected to be aware of the thermal properties thereof, or at least of the fabric type and/or recommended temperature settings, and to adjust the soleplate temperature of the iron in accordance therewith before he starts to iron the respective textile. Disregarding the recommended soleplate temperature setting may lead to unsatisfactory ironing results, and even thermal damage to the ironed material if the soleplate temperature inadvertently exceeds the maximum recommended temperature.

The need to be aware of the thermal properties of a fabric and to adjust the soleplate temperature of the iron upon changing from one fabric type to another (if the current setting is unsuitable) is considered laborious and user-unfriendly. It appears, however, to be necessitated by the inherently different thermal properties of different textiles.

In an attempt to provide for a more user-friendly iron WO 2008/034693-A1 discloses a steam iron including a heatable iron base, a heating device for heating the iron base, and an integrated automatic temperature control device which is coupled to the heating device and designed to keep the ironing temperature of the iron base exclusively in a fixedly preset, manually nonchangeable, constant ironing temperature range from 180° C. to 190° C. during operation of the steam iron. WO'693 teaches that all textiles, in particular garments and household textiles, that do not include special industry textiles can be ironed within said temperature range with 'very good' ironing results. Allegedly, 'good' ironing results are still obtained when the items are dry-ironed, i.e. without the application of steam. WO'693 further advises that textiles, which according to EN 60311 have a maximum ironing temperature of 160° C. (i.e. two-dot-textiles, see Table 1), can be steam ironed with 'good' results in the said temperature range of 180-190° C.

Tests performed by the applicant of the present application have not been able to confirm the claims made by WO'693. It appears that delicate items are awarded with a one-dot ironing temperature indication in their care labels for a reason. For example, efforts to iron one-dot acrylic garments using an iron at a soleplate temperature of 165° C. (indeed still safely outside the range claimed by WO'693), both with and without the use of steam, have resulted in damage to the garments in the form of permanent stiffening of the textile. In fact, the tests revealed that even two-dot items, such as garments from polyester or wool, are preferably not ironed at this temperature as this is bound to lead to irreversible damage during normal ironing practice. In the case of a partially polyester garment (65% polyester, 35% cotton) the ironing resulted in stiffening of the textile, while in the case of a 100% polyester garment the material was observed to soften and stick to the iron's soleplate. In another test the dry ironing of a woolen garment at a soleplate temperature of 165° C. led to noticeable discoloration. It is expected that the thermal damage observed in these tests would be more pronounced if the soleplate temperature were raised to within the range of 180-190° C. that is recommended by WO'693.

The degree of damage inflicted by an iron with an overheated soleplate may presumably be mitigated by continuously moving the iron across the garment at an exceptionally rapid pace, thereby essentially preventing the transfer of large amounts of heat from the soleplate to a single patch of the fabric. Such ironing behavior, however, is rather tiring and would require the average user to adjust his ironing habits. In a practical sense, the above-described tests thus seem to verify the commonly held belief that an ironing temperature is best chosen in dependence of the type of fabric of the item so as to avoid damage and to obtain satisfactory ironing results.

As the problem addressed by WO'693 is yet unsolved, it is an object of the present invention to provide for an ironing device with which different fabric types can be ironed with satisfactory ironing results, without requiring the user to adapt any ironing settings upon switching from one textile to another.

SUMMARY OF THE INVENTION

One aspect of the present invention is directed to a steam ironing device. The ironing device may include an iron including a soleplate that is provided with at least one steam outlet opening, and soleplate heating means configured to heat the soleplate. The ironing device may further include a steam generator comprising a heatable steam generation chamber that is fluidly connectable or connected to the at least one steam outlet opening in the soleplate. The ironing device may also include control means that are operably connected to the soleplate heating means and the steam generator, and configured to control a soleplate temperature and a steam rate of the steam ironing device. The control means may be configured to heat the soleplate to a non user-adjustable temperature in the range of 105-145° C., and to provide for a time-averaged steam rate of at least 50 grams/minute.

The ironing device according to the present invention is based on research that, quite surprisingly and contrary to popular belief, has revealed that satisfactory ironing results for diverse fabric types may be achieved at universal temperature and steam settings. To this end, the ironing device according to the present invention combines a relatively low, manually non-adjustable soleplate temperature with a relatively high minimum steam rate.

The lower boundary of the soleplate temperature range, 105° C., is chosen sufficiently high to avoid condensation of steam as it is emitted from the at least one steam outlet opening in the soleplate. Condensation is preferably avoided since it may result in temporary wet stains due to dripping and/or cause water spitting. The upper boundary, 145° C., is selected from the perspective of fabric safety and is sufficiently low to prevent scorching or other damage of delicate items. In particular for items with a one-dot temperature indication the safety of the upper temperature boundary, which may fall outside of the one-dot temperature range (cf. Table 1), is warranted by the constant emission of a substantial steam flow from the soleplate. The temperature range of (125±20)° C. may be narrowed to (125±10)° C. to enhance the above effects and make the iron's behavior more robust and safe in non-standard ironing conditions (for example involving thick, cold and thermally conductive items that may temporarily draw the soleplate temperature down to about 100° C.). The temperature of 125° C. at the center of these ranges has been found to provide for good results, as will be discussed in more detail below.

The minimum time-averaged steam rate that has been found to consistently provide for acceptable ironing results is about 50 grams/minute. Higher steam rates may at least for some textiles—improve the ironing results, but time-averaged steam rates above 70 grams/minute do not appear to significantly improve the ironing results any further.

The term 'time-averaged', used in relation to the steam rate of the ironing device, intends to include both embodiments that feature continuous or constant, and non-continuous or time-variable steam emission. For the first category, the time-averaged steam rate may typically be the same as the instantaneous steam rate. For embodiments in the second category, however, this is not the case. A steam system iron may, for example, be configured to intermittently release steam at peak rates well above 70 grams/minute while its time-averaged steam rate may still fall within the range of 50-70 grams/minute. For instance, a system iron may be configured to release steam in repeating cycles of 20 seconds, each cycle including 5 (consecutive) seconds of releasing steam at a rate of 240 grams/minute, followed by 15 seconds during which no steam is released. Such a scheme brings the time-averaged steam rate to 60 grams/minute. For the purpose of determining the time-averaged steam rate of an iron, one may normally average the steam rate over a period of sixty seconds or less, depending on whether or not the steam release pattern exhibits periodicity, and if so, the duration of the period involved.

It is noted that the specified minimum steam rate is applicable only when the ironing device is used for actual ironing. That is: the control means may include a sensor for registering at least one of a motion of the iron, a position/orientation of the iron and contact between the soleplate and a fabric being ironed, and additionally be configured to adapt, in particular to halt or reduce, the release of steam below the minimum steam rate when a signal from the sensor reflects that the soleplate is not in contact with a fabric being ironed, i.e. is not being used for actual ironing. A motion sensor may for example detect that an iron is being lifted, a position/orientation sensor may detect that the iron is placed on its heel, and a contact sensor may detect that the soleplate is out of contact with a fabric being ironed, all of which situations may occur during an ironing job, for instance during a period of exchanging an ironed item for another item to be ironed.

The steam used by the steam ironing device has the double function of heating up and moistening an item to be ironed. Studies have shown that steam is more effective in heating an item than a hot soleplate due to the involvement of mass transfer and latent heat. However, if the temperature of the steam is chosen too high, too little steam may condense in the material to both transfer sufficient heat and suitably moisten the item's fabric. A good balance may be struck by using steam at temperatures of less than 150° C., e.g. temperatures in the range of about 100-150° C. The pressure of the steam, both within the steam generator and upon release from the soleplate, is preferably kept below about six bars of absolute pressure.

Without wishing to be bound by theory, the fact that a combination of a relatively low soleplate temperature and a relatively high steam rate appears to provide for good ironing results may be explained as follows.

During ironing, a fabric is typically heated to loosen the inter-molecular bonds between the long-chain polymer molecules in the fibers of the fabric. In their loosened condition the weight of the iron may force the fibers in a wrinkle-free state. When the stress in the fibers is properly removed the wrinkle-free state of the fabric will be largely maintained upon cooling. The removal of stress in the fibers of the fabric is significantly enhanced by heating the fabric to above its glass transition temperature. For many (in particular natural) fabrics, such as cotton, wool and linen, the glass transition temperature is dependent on the moisture content. The dependency is such that an increase in the moisture content or humidity lowers the transition temperature. A higher moisture content may thus improve the degree of stress relaxation, and hence the ironing result at the same temperature. To ensure that a fabric can be suitably moistened, the ironing temperature of the iron (which results from both the soleplate temperature and the steam settings) should not be chosen too high; after all, the higher the ironing temperature, the higher the temperature to which the fabric that is being ironed is heated, and the lower the condensation rate of steam within the fabric.

Once an item has been ironed, wrinkles that were smoothed out may partially return as the fibers of the fabric cool off. The comeback of the wrinkles is conjectured to be caused by shrinkage of the fibers during the period of cooling off that naturally follows a period of heating during ironing. In general, fibers that are heated to a lower temperature are observed to undergo less thermal expansion than fibers that are heated to a higher temperature. As a result, the degree of shrinkage to which the former fibers are subsequently subjected upon cooling is also lower. Heating an item to a lower temperature may thus contribute to the reduction of wrinkle revival.

The soleplate temperature and steam rate of the steam ironing device according to the present invention have been selected empirically. The respective values are considered to strike a balance between the above-described factors, and thus to enable sufficient moisturization and consequent relaxation of the fabric fibers without causing their unnecessary heating and accompanying thermal expansion.

As mentioned, the steam ironing device according to the present invention may feature a non user-adjustable soleplate temperature. In addition, in some embodiments of the ironing device the steam settings, e.g. the steam rate and steam temperature, may also be non-user adjustable.

Non user-adjustable soleplate temperature and steam settings enable the construction of a simpler ironing device, which is advantageous from both the viewpoint of user-friendliness and manufacturing economy since there is no need for special user controls. It should be noted, however, that the term non-user-adjustable is not to be construed as necessarily meaning that the parameter in question is fixed, constant or invariable. Instead, the word is to be construed as meaning that the ironing device does not include a user control that enables a user to adjust the respective parameter by performing an action that extends beyond the natural operation of an iron that is (already) set to the desired soleplate temperature and steam characteristics. Such natural operation may for example include gripping the iron, moving the iron across a garment, lifting the iron from the garment, placing the iron on its heel and releasing the iron. Hence, a non user-adjustable soleplate temperature may, for example, be variable by the respective (automatic) control means in dependence of a signal from a hand or grip sensor that registers when the iron is being held by a user, such that the soleplate temperature is lowered or otherwise adjusted when the sensor's signal reflects that the iron has not been held for a significant period of time, e.g. fifteen minutes or half an hour. Likewise, as mentioned above, a non user-adjustable steam rate may be variable by the respective (automatic) control means in dependence of a signal from a motion, position/orientation or contact sensor, such that the release of steam is halted or reduced when the sensor's signal reflects that the iron is placed on its heel, suspended in the air, or lowered onto an item to be ironed at the beginning of an ironing stroke. It is understood however, that in some embodiments of the ironing device, at least one of the soleplate temperature and the steam rate settings may be fixed and invariable i.e. changeable by neither a user nor a control means so as to do away with automated control functionality, and to simplify the construction of the device with an eye to manufacturing costs.

These and other features and advantages of the invention will be more fully understood from the following detailed description of certain embodiments of the invention, taken together with the accompanying drawings, which are meant to illustrate and not to limit the invention.

DETAILED DESCRIPTION OF THE EMBODIMENTS

Figure 1:
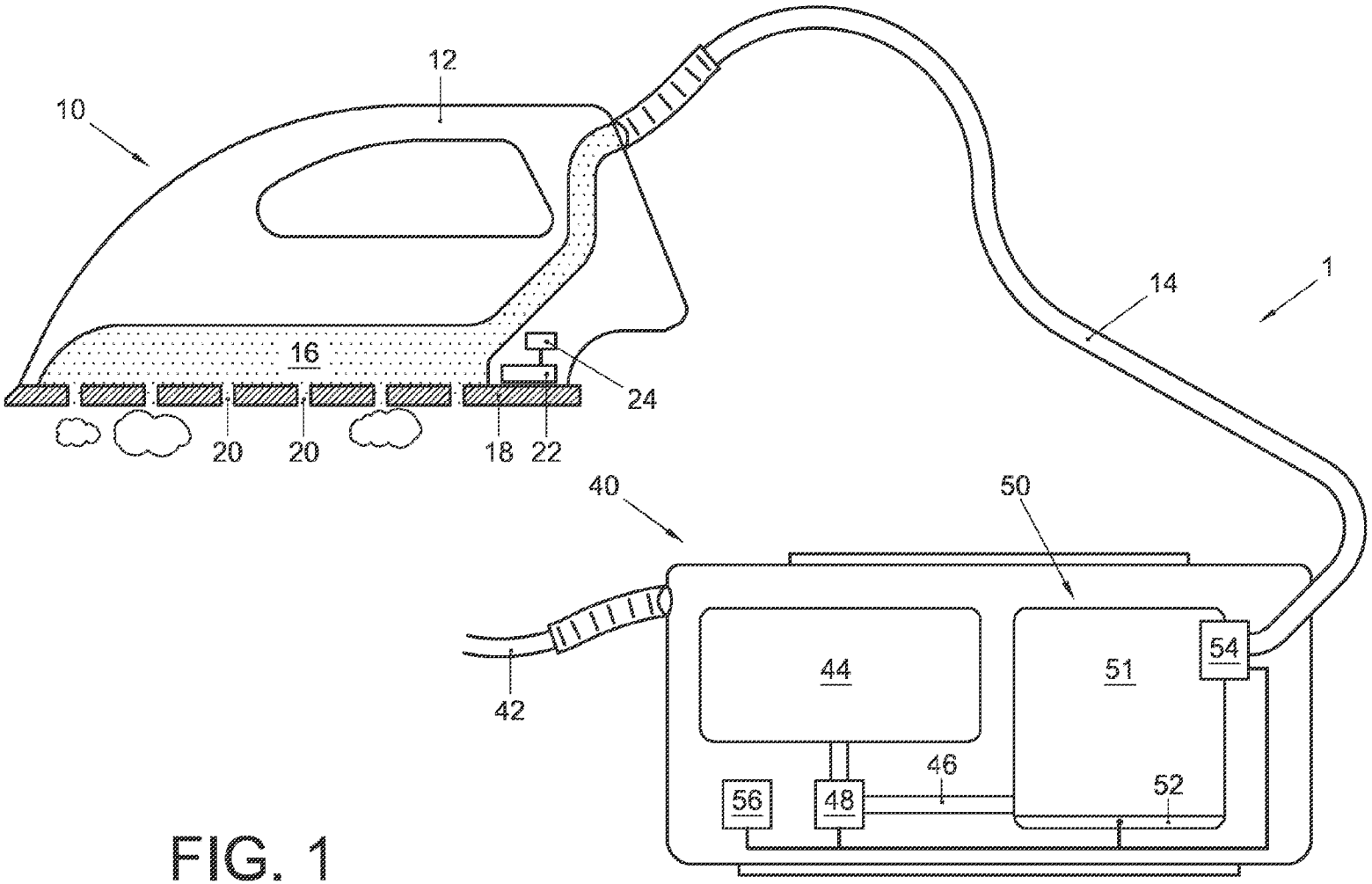
FIG. 1 schematically illustrates an exemplary steam ironing device according to the present invention.

FIG. 1 schematically illustrates an exemplary steam ironing device 1 according to the present invention. The steam ironing device 1, which is designed as a system iron, may include an iron 10 and a base unit 40 accommodating a steam generator 50.

The iron 10—i.e. the hand-held part of the ironing device 1—may include a handle 12 and a heatable soleplate 18 with a plurality of steam outlet openings 20. The handle 12 may be disposed at an upper side of the iron 10, and be configured to enable a user to pick up the iron and move the soleplate 18 provided at the lower side thereof over an item to be ironed. The steam outlet openings 20 in the soleplate 18 may be in fluid communication with an integrated steam chamber 16, which may be supplied with steam via the flexible combined steam hose/power cord 14. For the purpose of heating the soleplate 20, soleplate heating means 22 may be provided. These soleplate heating means 22 may preferably comprise at least one flat resistive heating element arranged on a surface of the soleplate 20, but alternative embodiments of the soleplate heating means 22 are also possible. One such alternative embodiment may for example include a conventional tubular heating element which is cast into the (aluminum) soleplate, or a PTC (Positive Temperature Coefficient) based heater in good thermal communication with the sole plate.

The term 'flat resistive heating element' refers to a heating elements that is deposited as a thin layer on a surface by means of printing or another suitable technique, and that, under the influence of an electric current, is capable of generating heat. An example of such a heating element is a layer of synthetic resin in which electrically conductive particles are embedded. In case a flat resistive heating element is arranged on a surface comprising an electrically conductive material such as metal, an electrically insulating layer may need to be arranged between the surface and the heating element to avoid short-circuiting.

The soleplate heating means 22 may be operably connected to first control means 24, which may take the form of a thermostat. In case the soleplate heating means include a PTC-heater thermostat functionality may be dispensed with. The first control means 24 may be configured to heat the soleplate 18 to a non user-adjustable temperature in the range of 105-145° C. during use. In a preferred embodiment, the target temperature in this range to which the first control means 24 are configured to heat the soleplate 18 may be fixed, for example at 125° C., as this allows for the simplest and therefore most economical construction of the first control means 24.

The base unit 40 may house a refillable water reservoir 44 for containing water, a steam generator or boiler 50 for generating and supplying steam, a water channel 46 that fluidly interconnects the water reservoir 44 and a steam generation chamber 51 of the steam generator 50, and a pump 48, arranged in the water channel 46, and configured to force water to flow from the water reservoir 44 into the steam generation chamber 51.

For the purpose of heating water contained in the steam generation chamber 51, the steam generator may comprise steam generator heating means 52. Like the soleplate heating means 22, the steam generator heating means 52 may preferably include at least one flat resistive heating element, but it is also possible that the steam generator heating means 52 are designed in another way, for example, as a conventional tubular heating element or a PTC-based heater that is thermally coupled with the steam generation chamber. The steam generation chamber 51 may be connected to the steam chamber 16 of the iron 10 via the thermally insulated combined steam hose/power cord 14. The steam generator 50 may further include an electrically controllable steam valve 54 via which the steam generation chamber 51 is connectable to the steam hose 14 and the steam chamber 16.

The pump 48, the steam valve 54 and the steam generator heating means 52 may all be controlled by second control means 56. Accordingly, these second control means 56 may be configured to control the steam settings of the ironing device 1, e.g. the steam rate, and the steam temperature and pressure. The control means 56, which may include a simple integrated circuit (IC), may control the steam settings autonomously, typically in accordance with preprogrammed steaming instructions that may define a certain steaming pattern/cycle. In some embodiments of the steam system iron 1, the second control means 56 may include one or more sensors, e.g. position/orientation, motion or contact sensors, capable of detecting a condition for which the preprogrammed steaming instruction provide an adjustment of the steam settings. The second control means 56 may, for example, include an orientation sensor (disposed in the iron 10, not shown) that is capable of detecting a vertical orientation of the steam iron 10, while the second control means may further be configured such that, upon the detection of a vertical orientation of the steam iron 10, the steam rate of the ironing device 1 is reduced, and vice versa.

The ironing device 1 may be connected to the mains via a power cord 42, via which all electrical components of the ironing device may be provided with electrical energy, possibly through the intermediation of a suitable transformer.

The construction of the ironing device 1 may largely be of a conventional design. From a user as well as a constructional perspective, it may primarily be the lack of manually operable soleplate temperature and steam controls that sets the construction of the ironing device 1 apart from conventional (system) irons. Although FIG. 1 depicts the exemplary embodiment of the ironing device 1 according to the present invention as a 'steam system iron' (having a water reservoir 44 and a steam generator 50 external to the iron 10), it is contemplated that the ironing device may alternatively be implemented as a 'steam iron' (having a water reservoir and steam generator incorporated into the iron's body that is to be moved across a fabric during ironing).

Now that the construction of the ironing device according to the present invention has been described in some detail, attention is invited to its operation and performance.

From a user perspective the operation of the ironing device 1 is extremely simple, in particular compared to the operation of a conventional steam system iron. With such a conventional steam system iron, a user is required to check the settings of the iron's input means prior to the start of an ironing job in order to see if they reflect soleplate temperature and steam settings suitable for the item to be ironed. To be sure of the desired settings, he might have to look them up, for example in the textile care label or in the iron's user manual. In case the selected settings do not correspond to the desired settings, the user will have to adjust the settings of the input means. These steps may need to be repeated for every item to be ironed, which is obviously rather laborious. In contrast, the ironing device 1 according to the present invention may not include any user-adjustable soleplate temperature or steam settings. The preconfigured settings are suitable for safely ironing different types of fabric, including virtually all household textiles, with satisfactory ironing results.

Figure 2:
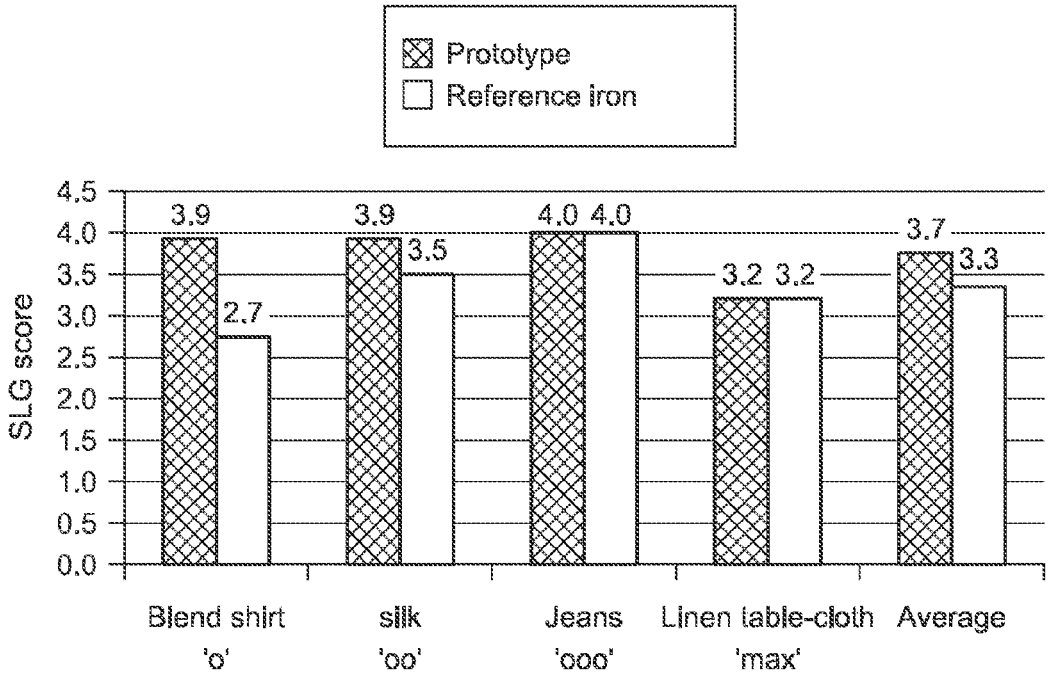
FIG. 2 shows SLG-rated ironing results obtained by ironing fabrics having different recommended ironing temperatures with a conventional steam system iron (configured in accordance with the user manual), and a prototype of a steam system iron according to the present invention.

As an indication of these ironing results and the performance of the ironing device according to the present invention, FIG. 2 illustrates ironing results obtained from a test in which fabric specimens with different recommended (maximum) ironing temperatures were ironed with both a prototype of a system iron according to the present invention and a conventional high-end reference system iron. The fabric specimens include (seen from left to right in the graph of FIG. 2):

a blend shirt, made of 40% polyester and 60% cotton, having 1-dot textile care marking (i.e. low temperature setting);

a silk garment, having a 2-dot textile care marking (i.e. medium temperature setting);

jeans, made of 100% thick cotton, having a 3-dot textile care label (i.e. high temperature setting), and a linen table-cloth, having a maximum temperature textile care marking During the test, the system iron according to the present invention was configured with a constant soleplate temperature of approximately 125° C. and a time-averaged steam rate in the range of 100-140 grams/minute; the steam was released from the soleplate at a temperature in the range of about 100-110° C. Hence, all fabric specimens ironed with the prototype system iron were ironed at the same conditions, irrespective of their nature. In contrast, fabric specimens ironed with the reference system iron were all ironed at a soleplate temperature in accordance with their care label (generally in the range of 115-145° C.; cf. Table 1), and at a time-averaged steam rate of approximately 100-140 grams/minute. It is noted that the selected time-averaged steam rate is relatively large compared to the minimum time-averaged steam rate of 50 grams/minute stated above. This was done merely to help shorten the ironing time; research has shown that the large steam rate in itself does not significantly influence the ironing results.

The ironing results were assessed four hours after ironing and rated on a scale devised for this purpose by SLG Prüf- and Zertifizierungs GmbH, which scale ranges from 1 to 5 and is roughly divided as follows:

TABLE 2

| Ironing result | Rating | Classification |
|---|---|---|
| Like original, heavily wrinkled. | 1 (1.0-1.5) | very poor |
| Hardly any wrinkles removed. Fabric not wearable/usable. | 2 (1.6-2.5) | poor |
| Overall appearance slightly wrinkled but wearable/usable | 3 (2.6-3.5) | satisfactory |
| Even small wrinkles removed; old wrinkles may be recognizable without being obvious. | 4 (3.6-4.5) | good |
| Very smooth appearance; even edges of fabric specimen are even. | 5 (4.6-5.0) | very good |

As may be inferred from FIG. 2, the system iron according to the present invention produces results that are better than those of the reference system iron for textiles that come with a recommended low or medium temperature setting, while the results for textiles with recommended high ironing temperatures are comparable. On average, the system iron according to the present invention thus scored better.

Figure 3A:
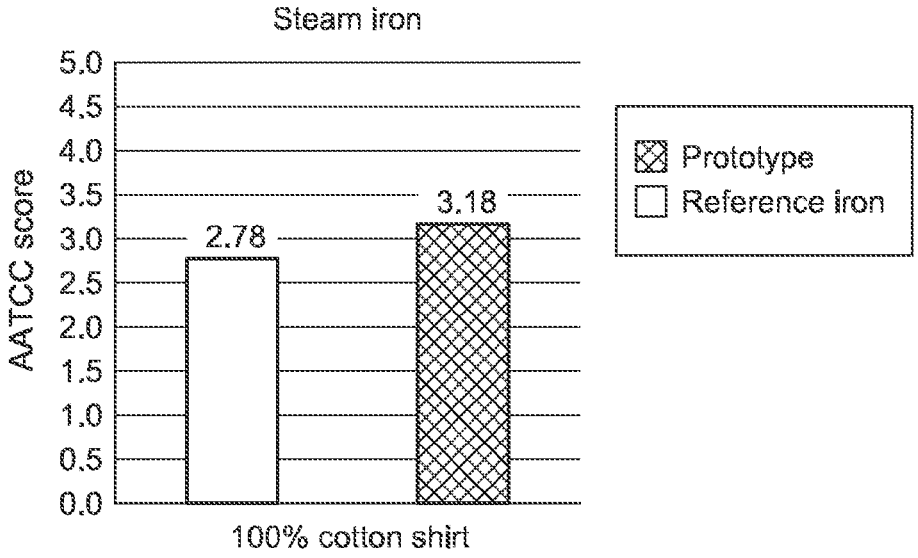
FIG. 3A shows AATCC-rated ironing results obtained by ironing a 100% cotton shirt with a conventional steam iron (configured in accordance with the user manual), and a prototype of a steam iron according to the present invention.
Figure 3B:
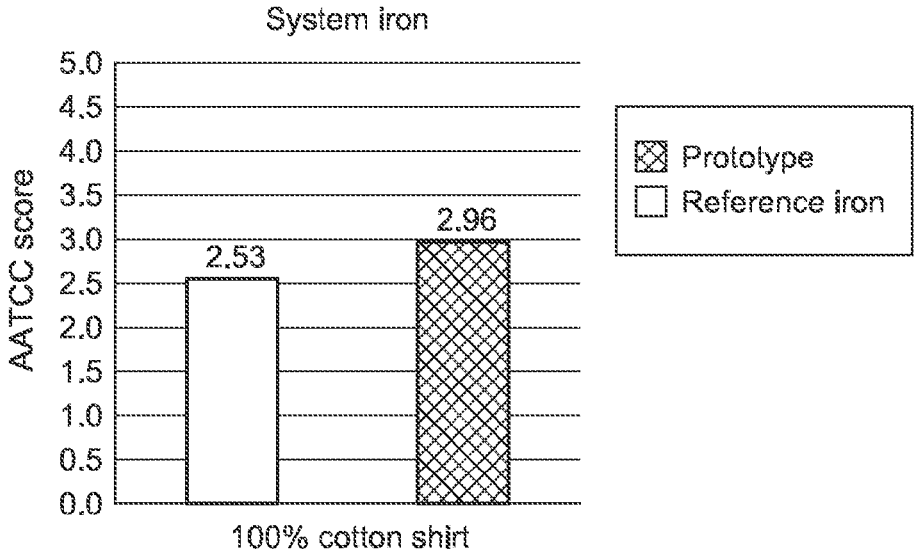
FIG. 3B shows AATCC-rated ironing results obtained by ironing a 100% cotton shirt with a conventional steam system iron (configured in accordance with the user manual), and a prototype of a steam system iron according to the present invention.

FIGS. 3A and 3B show test results obtained from two further ironing tests performed on a 100% cotton shirt, i.e. a textile with a recommended high temperature setting. For the test whose results are reflected by FIG. 3A, the cotton shirt was ironed with both a prototype of a steam iron according to the present invention and a conventional steam iron. During the test, both steam irons were configured with a time-averaged steam rate somewhat above 50 grams/minute; the soleplate temperature of the prototype was approximately 125° C., while that of the reference iron was approximately 175° C. For the comparative test whose results are shown in FIG. 3B, the cotton shirt was ironed with both a prototype of a steam system iron according to the present invention and a conventional, high-end reference steam system iron. Both steam system irons were configured with a time-averaged steam rate in the range of 100-140 grams/minute, and a soleplate temperature of approximately 125° C. and 175° C., respectively. The test results were assessed four hours after ironing, and rated on a scale devised for this purpose by the American Association of Textile Chemists and Colorists (AATCC). Unlike the SLG score system described above, the AATCC score system employs smoothness templates to which an ironed fabric-specimen can be compared to judge the ironing result. On the AATCC scale, which ranges from 0 to 5, scores of 2.5 and above represent satisfactory ironing results. As can be seen in FIGS. 3A and 3B, the prototypes of the ironing devices according to the present invention score better than their respective conventional counterparts.

On the basis of the above, it may be concluded that the ironing device according to the present invention performs competively, and generally better than conventional irons that are used in accordance with their directions for use.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

| List of elements | |
|---|---|
| 1 | steam ironing device |
| 10 | iron |
| 12 | handle |
| 14 | power cord/steam hose |

-continued

| List of elements | |
|---|---|
| 16 | steam chamber |
| 18 | soleplate |
| 20 | steam outlet opening in soleplate |
| 22 | soleplate heating means |
| 24 | first control means/thermostat |
| 40 | base unit |
| 42 | power cord |
| 44 | water reservoir |
| 46 | water channel |
| 48 | pump |
| 50 | boiler/steam generator |
| 51 | steam generation chamber |
| 52 | boiler heating means |
| 54 | boiler valve |
| 56 | second control means |

The invention claimed is:

1. A steam ironing device, comprising:

an iron, including a soleplate (18) provided with at least one steam outlet opening;

soleplate heating means configured to heat the soleplate;

a steam generator including a heatable steam generation chamber that is fluidly connectable to the at least one steam outlet opening in the soleplate; and control means operably connected to the soleplate heating means to control a soleplate temperature to a non-user-adjustable temperature in the range of 105-145° C., and to the steam generator to control steam settings to a non-user-adjustable temperature in the range of 100-150° C. at a time-averaged steam rate of at least 50 grams/minute.

2. The steam ironing device according to claim 1, wherein the control means are configured to heat the soleplate to a temperature in the range of 115-135° C.

3. The steam ironing device according to claim 1, wherein the steam rate is non user-adjustable.

4. The steam ironing device according to claim 1, wherein the control means are configured to provide for a time-averaged steam rate in the range of 50-70 gram/minute.

5. The steam ironing device according to claim 1, wherein the steam generator is configured to release steam at a pressure of less than 6 bar.

6. The steam ironing device according to claim 1, wherein at least one of the soleplate temperature and the steam rate is fixed and invariable.

7. The steam ironing device according to claim 1, wherein the control means include a sensor for registering at least one of a motion of the iron, a position/orientation of the iron and contact between the soleplate and a fabric being ironed, and wherein the control means are configured to halt the release of steam or to reduce the steam rate when a signal from the sensor reflects that the soleplate is not in contact with a fabric being ironed.

8. The steam ironing device according to claim 1, further comprising a base unit that accommodates the steam generator, to which base unit the iron is flexibly connected and with respect to which the iron is independently movable.

9. The steam ironing device according to claim 1, wherein the steam generator is incorporated in the iron.

* * * * *